US005651307A

United States Patent [19]

Reny

[11] Patent Number: 5,651,307

[45] Date of Patent: Jul. 29, 1997

[54] UNIVERSAL OIL FILTER CRUSHER ADAPTOR

[76] Inventor: Kenneth N. Reny, 3850 Navaho SW., Grandville, Mich. 49418

[21] Appl. No.: 555,702

[22] Filed: Nov. 14, 1995

[51] Int. Cl.[6] ..... B30B 9/32; B30B 9/04

[52] U.S. Cl. ..... 100/116; 100/125; 100/131; 100/902

[58] Field of Search ..... 100/110, 116, 100/125, 131, 902, 257, 269.01

[56] References Cited

U.S. PATENT DOCUMENTS

| | | | |
|---|---|---|---|
| 369,711 | 9/1887 | Hodson | 100/131 |
| 719,242 | 1/1903 | Martin | 100/257 |
| 1,182,023 | 5/1916 | McGregor | 100/257 |
| 2,221,806 | 11/1940 | Loomis | 100/125 |
| 4,334,469 | 6/1982 | Tanner et al. | 100/110 |
| 5,109,763 | 5/1992 | Morris et al. | 100/131 |
| 5,125,331 | 6/1992 | Wood | 100/37 |
| 5,136,934 | 8/1992 | Darby, Jr. | 100/125 |
| 5,182,988 | 2/1993 | Styfhoorn | 100/131 |
| 5,218,902 | 6/1993 | Triola | 100/90 |
| 5,297,479 | 3/1994 | Negus | 100/116 |
| 5,325,771 | 7/1994 | Morris | 100/37 |
| 5,331,888 | 7/1994 | Brown, Jr. | 100/125 |
| 5,337,656 | 8/1994 | Hollnagel | 100/98 R |

FOREIGN PATENT DOCUMENTS

| | | | |
|---|---|---|---|
| 59493 | 5/1954 | France | 100/125 |
| 136539 | 11/1902 | Germany | 100/125 |
| 359249 | 9/1938 | Italy | 100/116 |

*Primary Examiner*—Stephen F. Gerrity
*Attorney, Agent, or Firm*—Varnum, Riddering, Schmidt & Howlett LLP

[57] ABSTRACT

A compression device adaptor for compacting discarded oil filters having a compacting member (10) which is connected to various types of compression devices, such as a hydraulic press, by way of a compactor connector (12). Formed within compacting member (10) is an interior drain channel (30) providing escape of waste oil held within an oil filter (28) upon pressure being applied by operation of a compression device. An oil filter platform (20) accommodates oil filter (28) as well as containing excess oil and providing drainage of same through a drain port (22).

12 Claims, 2 Drawing Sheets

UNIVERSAL OIL FILTER CRUSHER ADAPTOR

BACKGROUND—TECHNICAL FIELD

This invention relates to an adaptor to be used with a compression device specifically for use in compacting automotive oil filters.

BACKGROUND—DESCRIPTION OF PRIOR ART

Within the automotive service industry there has been an increasing need for the proper disposal of discarded oil filters. Due to mandatory environmental compliance by State and Federal agencies, it will no longer be acceptable to discard the oil-filled, used filters in standard waste containers.

As a result of a growing concern for the proper disposal of hazardous waste, inventors created different types of oil filter crushing devices which are large, complex pieces of equipment. The apparent complexity and somewhat exotic components of the prior art, for example U.S. Pat. Nos. 5,125,331 (1992), 5,136,934 (1992), 5,218,902 (1993), 5,325,771 (1994), 5,331,888 (1994), and 5,337,656 (1994), are costly to produce and out of the realm of purchase for an independent automotive service facility. In addition to being expensive pieces of equipment, the prior art is also costly to maintain in regards to servicing such complex assemblies.

In reviewing foreign prior art, for example French patent 59,493 (1954), and German patent 136539 (1902), it is apparent that these inventions are simple compression devices not specifically designed for automotive oil filter applications. These designs do not accommodate for extraction and containment of the used oil within a discarded oil filter. In addition, such devices significantly slow down the compacting process as well as require more physical force to operate.

SUMMARY OF THE INVENTION

The greatest advantage of the oil filter crushing device of this invention, as opposed to the prior art, is its form comprising a basic adaptor that connects to a compression device, for example, a hydraulic press having removable pressing tools (a standard piece of equipment in many automotive service facilities). This invention is less space consuming, fitting to an already existing piece of equipment, and is more cost efficient for the small, independent shop owner to purchase. Additionally, this invention will allow for greater compliance with environmental requirements regarding proper disposal of hazardous waste.

Unique to my design is an interior channel which enables the waste oil contained within the filter to escape easily upon compression being applied. As a result, release of the captured oil allows significantly less pressure to build inside the oil filter, and in turn, requires less physical force to perform the crushing operation.

The basic design of my oil filter crusher adaptor requires little or no maintenance as a result of the few, readily available parts comprising of its final assembly.

In light of the fact that the present invention is quickly and easily installed to an existing piece of equipment, coupled with the above forementioned advantages, makes it a practical alternative to the prior art.

DETAILED DESCRIPTION OF THE PREFERRED EMBODIMENT

Figure 1:
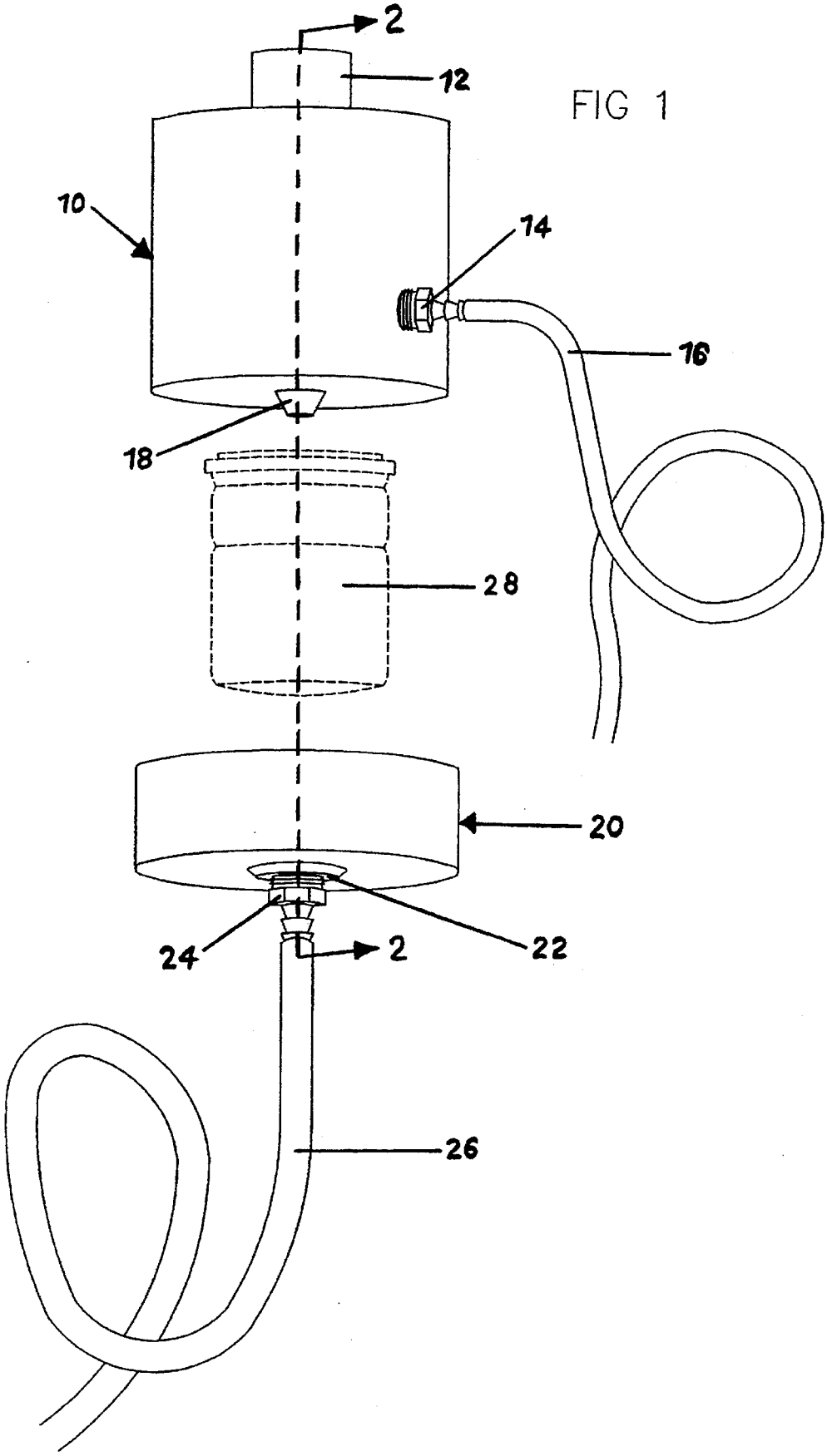
FIG. 1 is a front perspective view of an upright oil filter crusher adaptor, with an oil filter 28 (shown in dashed line) positioned upside down as in accordance with the invention.

A typical embodiment of the oil filter crusher adaptor of the present invention is illustrated in FIG. 1. The adaptor has a compacting member 10 comprising a hard material resistant to pressure. In the preferred embodiment, compacting member 10 is machined out of aluminum stock, however, other materials that can withstand repeated, industrial application as well as an ability to resist corrosion due to long term contact with automotive waste oil and grease can be used. In addition, its configuration may be cutout, formed, or stamped out by other manufacturing processes, for example die cast.

At the topmost portion of compacting member 10 is a compactor connector 12 which provides for attachment of compacting member 10 to a compression device. Connector 12 is produced in various standard sizes so as to be received in a standard chuck of different types of hydraulic presses, those of which vary depending on make and model. With regard to the preferred embodiment, the diameter of connector 12 typically measures 19 mm to 38 mm, however, other methods of fastening the unit to a standard chuck may be implemented.

Figure 2:
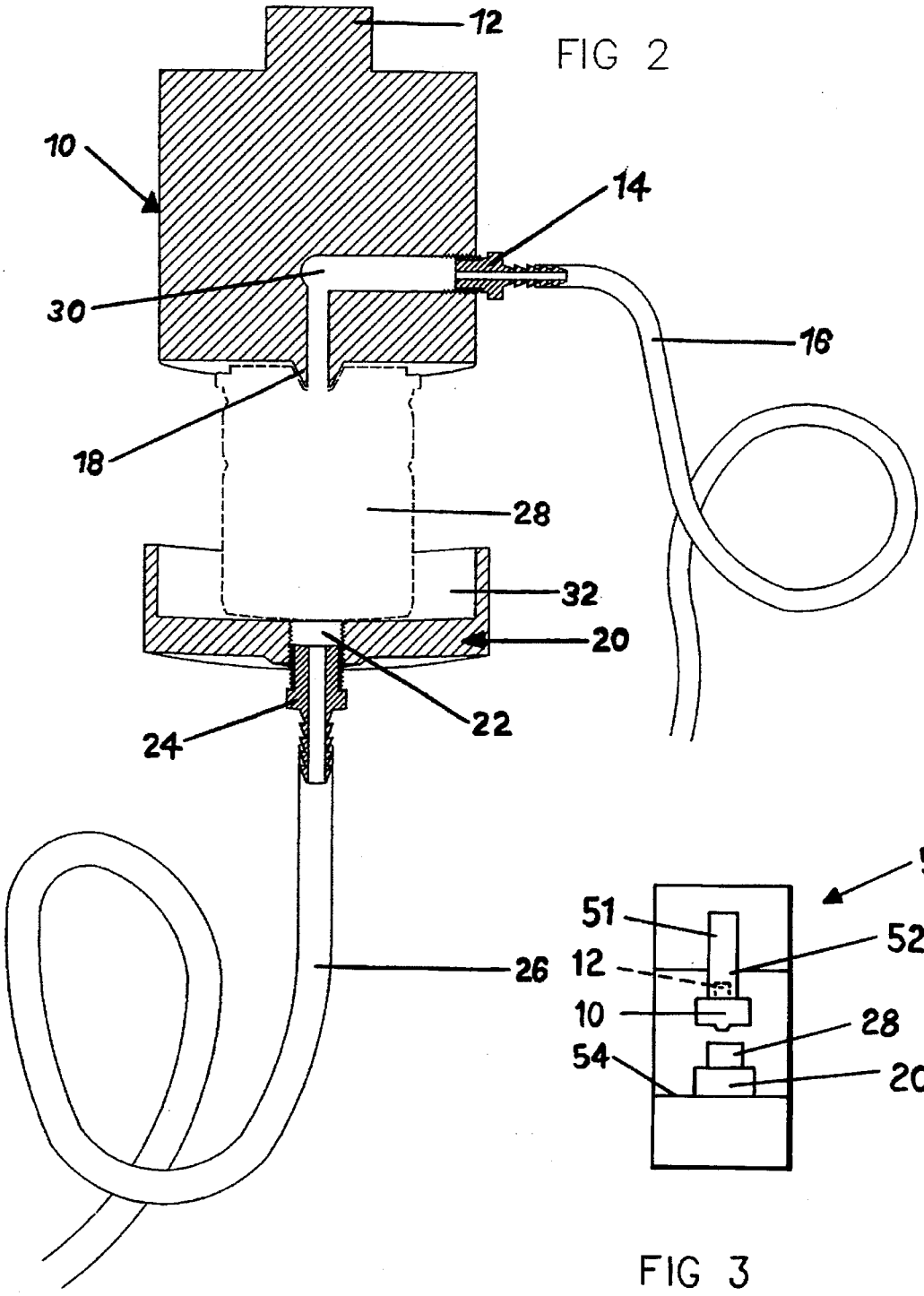
FIG. 2 is a cross-sectionals of the oil litter view crusher adaptor taken along line 2—2 of FIG. 1.

Centered on the bottom surface of compacting member 10 is a vertical positioner 18 in the form of an inverse frustroconical boss which serves to fit within a central aperature of an oil filter 28 to centrally align the oil filter with respect to the compacting member. The shape of positioner 18 permits a variety of oil filters with varying central aperture dimensions to be correctly positioned. Oil filter 28 is positioned on an oil filter platform 20 upside down. The direction specified is necessary for proper extraction and drainage of waste oil contained within oil filter 28. Extending upwardly from vertical positioner 18 is an interior drain channel 30 (FIG. 2) which is drilled within compacting member 10. Channel 30 changes direction within compacting member 10 and exits out an exterior side wall. In FIG. 2, channel 30 is illustrated to exit the right side of compacting member 10, however, channel 30 may be routed in various different formations to realize effective results of operation.

At the point of which channel 30 exits an exterior side wall of compacting member 10, a compactor fitting 14 is attached to allow for connection of a compactor drain line 16. The main function of drain line 16 is containment of the extracted waste oil while directing the same to an approved container (not shown) for recycling. With reference to the adaptor of the present invention, compactor fitting 14 is preferably constructed of a 6 mm hose barb, and compactor drain line 16 is preferably constructed of 12 mm vinyl tubing, although, other materials able to escape potential deterioration associated with long term exposure to automotive waste oil and grease may be used to produce the same. Additionally, other methods of allowing contained drainage may be implemented.

Situated below compacting member 10 is an oil filter platform 20 containing a receiving and collecting reservoir 32 (FIG. 2). platform 20 provides a centrally located base in which to position oil filter 28. Reservoir 32, contained therein, collects extracted waste oil that may escape the top portion of the adapter (compacting member 10) and flow down the side of oil filter 28. Located at the bottom, center of oil filter platform 20 is a drain port 22 (FIG. 2) which is a hole that is drilled from the outside surface of platform 20, through to reservoir 32. A platform fitting 24 is attached to the bottom-most portion of drain port 22 which serves as a connector for a platform drain line 26, thus providing an escape for any waste oil caught in receiving and collecting reservoir 32. Such contained waste oil may then be directed to an approved container (not shown) for collection and recycling.

In its preferred embodiment, oil filter platform 20, and the components thereof, are produced from the same materials as compacting member 10 per the description above, however, materials and methods used for manufacture of the present invention are not restricted to the subject embodiment since other means of producing the same may be implemented.

Figure 3:
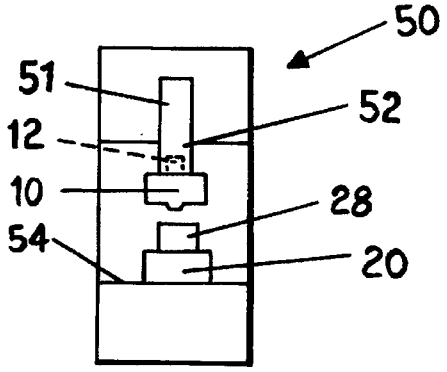
FIG. 3 is a schematic view of a hydraulic press and container crashing adaptor installed thereon.

With reference now to FIG. 3, in order to achieve effective operation of an oil filter crusher adaptor of this invention, it must be installed to a compacting device 50 such as a standard hydraulic press having a hydraulic cylinder 51. Compactor connector 12 (shown in dashed line) of a compatible dimension is inserted into an opening in the chuck 52 of the hydraulic press 50 and oil filter platform 20 is then positioned on the shelf 54 of the press 50. Once upper and lower members 10, 20 of the adaptor are installed, compactor drain line 16 and platform drain line 26 are then directed to, and inserted in the opening of any type approved container (not shown) which should be placed in close proximity to the hydraulic press in order to receive extracted waste oil.

When upper and lower members of the adaptor are installed, and drain lines 16 & 17 are received by a container, oil filter 28 is placed in an upside down position directly on the center of oil filter platform 20, resting inside receiving and collecting reservoir 32. Upon manual operation of the compression device with the adaptor of the subject invention installed, compacting member 10 is continually lowered until it engages oil filter 28 and begins compacting the same. Due to the constant force of such a device, oil filter 28 is compacted to approximately one quarter of its original height while simultaneously allowing the waste oil contained within to escape through compactor drain line 16 and platform drain line 26.

The compression operation is then reversed to raise compacting member 10 back to its starting position and oil filter 28 is removed (now in its compressed form) from oil filter platform 20, ready for proper disposal. In addition, waste oil that was held within oil filter 28 is captured and ready for recycling.

As a result of its basic design, the oil filter crusher adaptor of this invention can be easily fitted to any standard compression device and can be just as easily removed and stored for future use. In addition, the extraction and containment of waste oil, unique to this design, makes for a cleaner and safer compacting process with little physical effort. The fact that its form is that of an adaptor rather than a machine also makes it a more cost effective alternative for the small, independent shop owner to purchase, therefore, allowing greater compliance of proper hazardous waste disposal within the industry.

The above description should not be construed as limiting the scope of the invention, but merely illustrating the presently preferred embodiment of this invention. For example, the invention may be adapted to other types of compression machines or devices, other materials and processes may be used to manufacture it, and its function may be applied to items or objects other than strictly discarded automotive oil filters.

Thus, the scope of the invention should be determined by the appended claims and their legal equivalents, rather than by the examples given.

I claim:

1. A container crushing adaptor for removable installation on a press, the press having a chuck with an opening for removably receiving pressing tools and a support shelf for resisting forces from the chuck, the container crushing adaptor comprising:

a compacting portion having a first end and an opposing second end;

a connector attached to the first end of the compacting portion and adapted to be inserted into the chuck for opening for removably securing the compacting portion to the chuck, the second end of the compacting portion being adapted for contacting a container to be crashed;

a platform portion having a first end and an opposing second end, the first end of the platform portion being adapted for contacting the container and including a reservoir for receiving any fluid from within the container and the second end of the platform portion being adapted to removably contact the support shelf;

whereby the container is crushed as the space between the compacting portion and the platform portion is diminished due to relative movement between the chuck and the shelf.

2. The container crushing adaptor according to claim 1 wherein a drain port extends from an inlet opening in the reservoir to an outlet opening on the platform portion spaced from the inlet opening.

3. The container crushing adaptor according to claim 1 wherein a drain channel extends from an inlet opening in the Second end of the compacting portion to an outlet opening spaced from the inlet opening.

4. The container crushing adaptor according to claim 1 wherein the second end of the compacting portion includes a positioner for aligning the container with respect to the compacting portion.

5. The container crushing adaptor according to claim 4 wherein the positioner is frustro-conical to accommodate containers having different sized apertures.

6. The container crushing adaptor according to claim 4 wherein a drain channel extends from an inlet opening in the positioner to an outlet opening spaced from the inlet opening.

7. The container crushing adaptor according to claim 6 wherein the positioner is frustro-conical to accommodate containers having different sized apertures.

8. An oil filter crushing adaptor for removable installation on a press, the press having a chuck with an opening for removably receiving pressing tools and a support shelf for resisting forces from the chuck, the oil filter crushing adaptor comprising:

a compacting portion having a first end and an opposing second end;

a connector attached to the first end of the compacting portion and adapted to be inserted into the chuck opening for releasably securing the compacting portion to the chuck, the second end of the compacting portion being adapted for contacting an oil filter to be crushed;

a drain channel extending from an inlet opening in the second end of the compacting portion to an outlet opening spaced from the inlet opening;

a platform portion having a first end and an opposing second end, the first end of the platform portion being adapted for contacting the oil filter and including a reservoir for receiving any fluid from within the oil filter as the oil filter is crushed, the second end of the platform portion being adapted to releasably contact the support shelf; and a drain port extending from an inlet opening in outlet opening spaced from the drain port inlet opening;

whereby the oil filter is crushed as the space between the compacting portion and the platform portion is diminished due to relative movement between the chuck and the shelf, and fluid within the oil filter is drained trough the drain channel and drain port as the oil filter is crushed.

9. The oil filter crushing adaptor according to claim 8 wherein the second end of the compacting portion includes a positioner for aligning the oil filter with respect to the compacting portion.

10. The oil filter crushing adaptor according to claim 9 wherein the positioner is frustro-conical to accommodate oil filters having different sized apertures.

11. A container crushing adaptor for removable installation on a press, the press having a chuck and a support shelf for resisting forces from the chuck, the container crushing adaptor comprising:

a compacting portion having a first end and an opposing second end;

a connector attached to the first end of the compacting portion for removably securing the compacting portion to the chuck, the second end of the compacting portion being adapted for contacting a container to be crushed and including a positioner for aligning the container with respect to the competing portion;

a platform portion having a first end and an opposing second end, the first end of the platform portion being adapted for contacting the container, and the second end of the platform portion being adapted to removably contact the support shelf; and a drain channel extending from an inlet opening in the positioner to an outlet opening spaced from the inlet opening;

whereby the container is crushed as the space between the campacting portion and the platform portion is diminished due to relative movement between the chuck and the shelf.

12. The container crushing adaptor according to claim 11 wherein the positioner is frustro-conical to accommodate containers having different sized apertures.

* * * * *

UNITED STATES PATENT AND TRADEMARK OFFICE

CERTIFICATE OF CORRECTION

PATENT NO. : 5,651,307

DATED : July 29, 1997

INVENTOR(S) : Kenneth N. Reny

It is certified that error appears in the above-indentified patent and that said Letters Patent is hereby corrected as shown below:

Column 4, Line 34, Claim 3: delete the word "Second" and add the word --second--.

Column 5, Line 6, Claim 8: insert the words --the reservoir to an-- after the word "in".

Column 5, Line 11, Claim 8: delete the word "trough" and add the word--through--.

Signed and Sealed this

Twenty-eighth Day of October, 1997

*Attest:*

Bruce Lehman

BRUCE LEHMAN

*Attesting Officer*

*Commissioner of Patents and Trademarks*